US009241376B2

(12) United States Patent
Zhang et al.

(10) Patent No.: US 9,241,376 B2
(45) **Date of Patent: *Jan. 19, 2016**

(54) DRIVER FOR LED BACKLIGHT AND LED BACKLIGHT MODULE AND LIQUID CRYSTAL DISPLAY

(71) Applicant: Shenzhen China Star Optoelectronics Technology Co., Ltd., Shenzhen, Guangdong (CN)

(72) Inventors: Hua Zhang, Shenzhen (CN); Fei Li, Shenzhen (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 439 days.

This patent is subject to a terminal disclaimer.

(21) Appl. No.: 13/824,397

(22) PCT Filed: Mar. 11, 2013

(86) PCT No.: PCT/CN2013/072406

§ 371 (c)(1),
(2) Date: Mar. 18, 2013

(87) PCT Pub. No.: WO2014/134836

PCT Pub. Date: Sep. 12, 2014

(65) Prior Publication Data

US 2014/0253842 A1 Sep. 11, 2014

(30) Foreign Application Priority Data

Mar. 5, 2013 (CN) ..... 2013 1 0069884

(51) Int. Cl.
*G05F 1/00* (2006.01)
*H05B 33/08* (2006.01)
*G09G 3/34* (2006.01)

(52) U.S. Cl.
CPC ..... *H05B 33/0815* (2013.01); *G09G 3/3406* (2013.01)

(58) Field of Classification Search
CPC ..... H05B 37/02; H05B 33/0815; H05B 33/0848; H05B 33/0827; G09G 3/3406; G09G 3/3413; G09G 3/34
USPC ..... 315/290–294, 185, 192, 246, 312, 307; 345/82; 327/564
See application file for complete search history.

(56) References Cited

U.S. PATENT DOCUMENTS 7,592,756 B1 * 9/2009 Wu et al. ..... 315/307
8,139,019 B2 * 3/2012 Han et al. ..... 345/102

(Continued)

FOREIGN PATENT DOCUMENTS

CN 101340760 A 1/2009

OTHER PUBLICATIONS

Electronic Design—Sawtooth Generator Exhibits—Jul. 26, 1999 http://electronicdesign.com/components/sawtooth-generator-exhibits-1-linearity-and-over-80-db-dynamic-range http://electronicdesign.com/site-files/electronicdesign.com/files/archive/electronicdesign.com/files/29/6198/figure_01.gif.*

*Primary Examiner* — Alexander H Taningco
*Assistant Examiner* — Renan Luque
(74) *Attorney, Agent, or Firm* — Andrew C. Cheng

(57) ABSTRACT

LED backlight driver, LED backlight module, and liquid crystal display are disclosed. The LED backlight driver comprises DC voltage input end, boost circuit, LED string, and constant current driver. The DC voltage input end is used for inputting a DC voltage. The boost circuit is used for boosting the DC voltage input from the DC voltage input end and outputting a boosted DC voltage. The LED string comprises a plurality of LEDs connected in series and a first resistor. The LED string receives the boosted DC voltage from the boost circuit. A sum of forward voltages of all of the LEDs in the LED string is less than or equal to the boosted DC voltage output from the boost circuit. The constant current driver is used for outputting a level signal to the boost circuit based on a voltage across the first resistor and a voltage for a triangular signal.

17 Claims, 2 Drawing Sheets

(56) References Cited

U.S. PATENT DOCUMENTS 9,053,670 B2 * 6/2015 Zhang
2010/0264847 A1 * 10/2010 Chen et al. ..... 315/295
2010/0295876 A1 * 11/2010 Shin et al. ..... 345/690
2011/0248648 A1 * 10/2011 Liu ..... 315/294

* cited by examiner

DRIVER FOR LED BACKLIGHT AND LED BACKLIGHT MODULE AND LIQUID CRYSTAL DISPLAY

BACKGROUND OF THE INVENTION

1. Field of the Invention

The present invention relates to a liquid crystal display technology, more particularly, to a driver for an LED backlight and an LED backlight module and a liquid crystal display (LCD).

2. Description of the Related Art

With the progress of technology, the backlight technology for LCDs continues to develop. A backlight for a conventional LCD uses cold cathode fluorescent lamps (CCFLs). Since the CCFL backlight has the disadvantages of poor color restoration ability, low luminous efficiency, high discharge voltage, unsatisfied discharge characteristics at low temperatures, long heating time before the grey level being stabilized, a backlight using LEDs has already been developed.

However, in the prior art LED backlight driver, the driving signal output by the constant current driver has a fixed frequency. Its spectrum energy is thus concentrated at the harmonic frequencies of the fundamental wave. In electromagnetic interference (EMI) test, the peak value tends to be excessive which is not conductive to satisfied EMI test result.

SUMMARY OF THE INVENTION

The present invention provides an LED backlight driver. The LED backlight driver comprises a DC voltage input end, a boost circuit, an LED string, and a constant current driver. The DC voltage input end is used for inputting a DC voltage. The boost circuit is used for boosting the DC voltage input from the DC voltage input end and outputting a boosted DC voltage. The LED string comprises a plurality of LEDs connected in series and a first resistor. The LED string receives the boosted DC voltage from the boost circuit. A sum of forward voltages of all of the LEDs in the LED string is less than or equal to the boosted DC voltage output from the boost circuit. The constant current driver is used for outputting a level signal to the boost circuit based on a voltage across the first resistor and a voltage for a triangular signal.

In one aspect of the present invention, the constant current driver comprises a triangular wave generator for generating the triangular signal, and a third comparator use for comparing the voltage for the triangular signal and the voltage across the first resistor. A negative terminal of the third comparator receives the voltage for the triangular signal, a positive terminal of the third comparator receives the voltage across the first resistor, when the voltage for the triangular signal is higher than the voltage across the first resistor. An output terminal of the third comparator outputs a first level signal to the boost circuit, when the voltage for the triangular signal is lower than the voltage across the first resistor. The output terminal of the third comparator outputs a second level signal to the boost circuit.

In another aspect of the present invention, the boost circuit comprises an inductor, a third MOS transistor, a rectifying diode, and a second capacitor. One end of the inductor is used for receiving the DC voltage, another end of the inductor is connected to an anode of the rectifying diode. A drain of the third MOS transistor is connected to the inductor and the anode of the rectifying diode. One end of the second capacitor is connected to a cathode of the rectifying diode. Another end of the second capacitor is connected to a source of the third MOS transistor. A gate of the third MOS transistor is connected to the constant current driver.

In another aspect of the present invention, the triangular wave generator comprises a variable resistor, a first MOS transistor, a first comparator, a second comparator, a first capacitor, a second resistor, and a second MOS transistor. One end of the variable resistor receives an input voltage. Another end of the variable resistor is connected to a drain of the first MOS transistor. A source of the first MOS transistor is connected to one end of the second resistor and the negative terminal of the third comparator. Another end of the second resistor is connected to a drain of the second MOS transistor. A source of the second MOS transistor is electrically grounded. A gate of the first MOS transistor is connected to an output terminal of the first comparator. A gate of the second MOS transistor is connected to an output terminal of the second comparator. A negative terminal of the first comparator is connected to one end of the first capacitor and the source of the first MOS transistor. Another end of the first capacitor is electrically grounded. A positive terminal of the first comparator receives a first reference voltage. A negative terminal of the second comparator is connected to the output terminal of the first comparator. A positive terminal of the second comparator receives a second reference voltage.

In another aspect of the present invention, the frequency of the triangular signal is adjusted by adjusting the magnitude of the input voltage. When the input voltage is increased, a charging current passing through the first capacitor is increased. A charging voltage of the first capacitor is increased to make the triangular signal rise at a larger slope so the frequency of the triangular signal is increased. When the input voltage is decreased, the charging current passing through the first capacitor is decreased. The charging voltage of the first capacitor is decreased to make the triangular signal rise at a smaller slope so the frequency of the triangular signal is decreased.

In still another aspect of the present invention, the frequency of the triangular signal is adjusted by adjusting the magnitude of the resistance of the variable resistor. When the resistance of the variable resistor is decreased, a charging current passing through the first capacitor is increased. A charging voltage of the first capacitor is increased to make the triangular signal rise at a larger slope so the frequency of the triangular signal is increased. When the resistance of the variable resistor is increased, the charging current passing through the first capacitor is decreased. The charging voltage of the first capacitor is decreased to make the triangular signal rise at a smaller slope so the frequency of the triangular signal is decreased.

In yet another aspect of the present invention, the first level signal is a low level signal, and the second level signal is a high level signal.

The present invention further provides an LED backlight module comprising an LED backlight driver. The LED backlight driver comprises a DC voltage input end, a boost circuit, an LED string, and a constant current driver. The DC voltage input end is used for inputting a DC voltage. The boost circuit is used for boosting the DC voltage input from the DC voltage input end and outputting a boosted DC voltage. The LED string comprises a plurality of LEDs connected in series and a first resistor. The LED string receives the boosted DC voltage from the boost circuit. A sum of forward voltages of all of the LEDs in the LED string is less than or equal to the boosted DC voltage output from the boost circuit. The constant current driver is used for outputting a level signal to the boost circuit based on a voltage across the first resistor and a voltage for a triangular signal.

In one aspect of the present invention, the constant current driver comprises a triangular wave generator for generating the triangular signal, and a third comparator use for comparing the voltage for the triangular signal and the voltage across the first resistor. A negative terminal of the third comparator receives the voltage for the triangular signal, a positive terminal of the third comparator receives the voltage across the first resistor, when the voltage for the triangular signal is higher than the voltage across the first resistor. An output terminal of the third comparator outputs a first level signal to the boost circuit, when the voltage for the triangular signal is lower than the voltage across the first resistor. The output terminal of the third comparator outputs a second level signal to the boost circuit.

In another aspect of the present invention, the boost circuit comprises an inductor, a third MOS transistor, a rectifying diode, and a second capacitor. One end of the inductor is used for receiving the DC voltage, another end of the inductor is connected to an anode of the rectifying diode. A drain of the third MOS transistor is connected to the inductor and the anode of the rectifying diode. One end of the second capacitor is connected to a cathode of the rectifying diode. Another end of the second capacitor is connected to a source of the third MOS transistor. A gate of the third MOS transistor is connected to the constant current driver.

In another aspect of the present invention, the triangular wave generator comprises a variable resistor, a first MOS transistor, a first comparator, a second comparator, a first capacitor, a second resistor, and a second MOS transistor. One end of the variable resistor receives an input voltage. Another end of the variable resistor is connected to a drain of the first MOS transistor. A source of the first MOS transistor is connected to one end of the second resistor and the negative terminal of the third comparator. Another end of the second resistor is connected to a drain of the second MOS transistor. A source of the second MOS transistor is electrically grounded. A gate of the first MOS transistor is connected to an output terminal of the first comparator. A gate of the second MOS transistor is connected to an output terminal of the second comparator. A negative terminal of the first comparator is connected to one end of the first capacitor and the source of the first MOS transistor. Another end of the first capacitor is electrically grounded. A positive terminal of the first comparator receives a first reference voltage. A negative terminal of the second comparator is connected to the output terminal of the first comparator. A positive terminal of the second comparator receives a second reference voltage.

In another aspect of the present invention, the frequency of the triangular signal is adjusted by adjusting the magnitude of the input voltage. When the input voltage is increased, a charging current passing through the first capacitor is increased. A charging voltage of the first capacitor is increased to make the triangular signal rise at a larger slope so the frequency of the triangular signal is increased. When the input voltage is decreased, the charging current passing through the first capacitor is decreased. The charging voltage of the first capacitor is decreased to make the triangular signal rise at a smaller slope so the frequency of the triangular signal is decreased.

In still another aspect of the present invention, the frequency of the triangular signal is adjusted by adjusting the magnitude of the resistance of the variable resistor. When the resistance of the variable resistor is decreased, a charging current passing through the first capacitor is increased. A charging voltage of the first capacitor is increased to make the triangular signal rise at a larger slope so the frequency of the triangular signal is increased. When the resistance of the variable resistor is increased, the charging current passing through the first capacitor is decreased. The charging voltage of the first capacitor is decreased to make the triangular signal rise at a smaller slope so the frequency of the triangular signal is decreased.

In yet another aspect of the present invention, the first level signal is a low level signal, and the second level signal is a high level signal.

The present invention further provides a liquid crystal display. The liquid crystal display comprises a liquid crystal display panel and an LED backlight module. The liquid crystal display panel is disposed on the LED backlight module. The LED backlight module comprises an LED backlight driver. The LED backlight driver comprises a DC voltage input end, a boost circuit, an LED string, and a constant current driver. The DC voltage input end is used for inputting a DC voltage. The boost circuit is used for boosting the DC voltage input from the DC voltage input end and outputting a boosted DC voltage. The LED string comprises a plurality of LEDs connected in series and a first resistor. The LED string receives the boosted DC voltage from the boost circuit. A sum of forward voltages of all of the LEDs in the LED string is less than or equal to the boosted DC voltage output from the boost circuit. The constant current driver is used for outputting a level signal to the boost circuit based on a voltage across the first resistor and a voltage for a triangular signal.

In one aspect of the present invention, the constant current driver comprises a triangular wave generator for generating the triangular signal, and a third comparator use for comparing the voltage for the triangular signal and the voltage across the first resistor. A negative terminal of the third comparator receives the voltage for the triangular signal, a positive terminal of the third comparator receives the voltage across the first resistor, when the voltage for the triangular signal is higher than the voltage across the first resistor. An output terminal of the third comparator outputs a first level signal to the boost circuit, when the voltage for the triangular signal is lower than the voltage across the first resistor. The output terminal of the third comparator outputs a second level signal to the boost circuit.

In another aspect of the present invention, the boost circuit comprises an inductor, a third MOS transistor, a rectifying diode, and a second capacitor. One end of the inductor is used for receiving the DC voltage, another end of the inductor is connected to an anode of the rectifying diode. A drain of the third MOS transistor is connected to the inductor and the anode of the rectifying diode. One end of the second capacitor is connected to a cathode of the rectifying diode. Another end of the second capacitor is connected to a source of the third MOS transistor. A gate of the third MOS transistor is connected to the constant current driver.

In another aspect of the present invention, the triangular wave generator comprises a variable resistor, a first MOS transistor, a first comparator, a second comparator, a first capacitor, a second resistor, and a second MOS transistor. One end of the variable resistor receives an input voltage. Another end of the variable resistor is connected to a drain of the first MOS transistor. A source of the first MOS transistor is connected to one end of the second resistor and the negative terminal of the third comparator. Another end of the second resistor is connected to a drain of the second MOS transistor. A source of the second MOS transistor is electrically grounded. A gate of the first MOS transistor is connected to an output terminal of the first comparator. A gate of the second MOS transistor is connected to an output terminal of the second comparator. A negative terminal of the first comparator is connected to one end of the first capacitor and the source of the first MOS transistor. Another end of the first capacitor is electrically grounded. A positive terminal of the first comparator receives a first reference voltage. A negative terminal of the second comparator is connected to the output terminal of the first comparator. A positive terminal of the second comparator receives a second reference voltage.

In another aspect of the present invention, the frequency of the triangular signal is adjusted by adjusting the magnitude of the input voltage. When the input voltage is increased, a charging current passing through the first capacitor is increased. A charging voltage of the first capacitor is increased to make the triangular signal rise at a larger slope so the frequency of the triangular signal is increased. When the input voltage is decreased, the charging current passing through the first capacitor is decreased. The charging voltage of the first capacitor is decreased to make the triangular signal rise at a smaller slope so the frequency of the triangular signal is decreased.

In still another aspect of the present invention, the frequency of the triangular signal is adjusted by adjusting the magnitude of the resistance of the variable resistor. When the resistance of the variable resistor is decreased, a charging current passing through the first capacitor is increased. A charging voltage of the first capacitor is increased to make the triangular signal rise at a larger slope so the frequency of the triangular signal is increased. When the resistance of the variable resistor is increased, the charging current passing through the first capacitor is decreased. The charging voltage of the first capacitor is decreased to make the triangular signal rise at a smaller slope so the frequency of the triangular signal is decreased.

In yet another aspect of the present invention, the first level signal is a low level signal, and the second level signal is a high level signal.

In contrast to the prior art, the LED backlight driver, the LED backlight module, and the liquid crystal display according to the present invention spread the spectrum energy of the driving signal by moving the frequency of the driving back and forth around the center frequency. In EMI test, the peak value of the driving signal will not be easily to be excessive. As a result, the EMI test results are improved.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
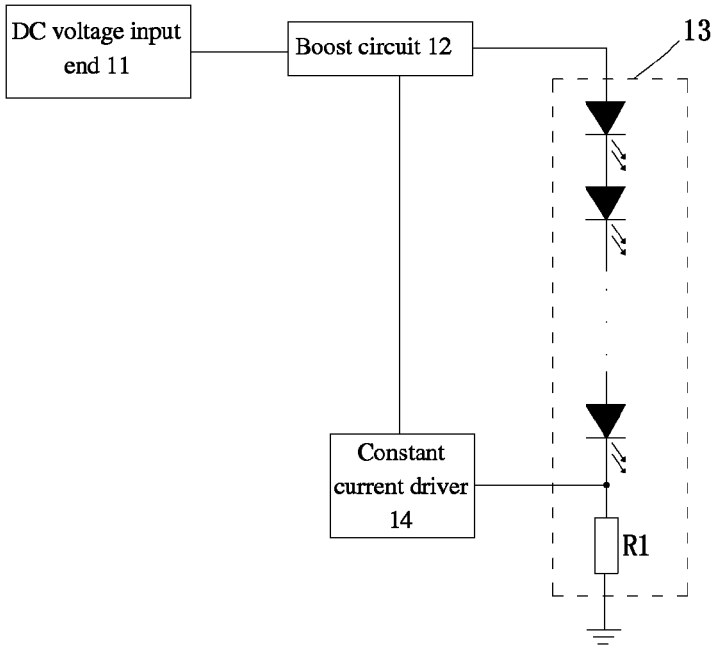
FIG. 1 shows a block diagram of an LED backlight driver according to an embodiment of the present invention.

FIG. 1 shows a block diagram of an LED backlight driver according to an embodiment of the present invention.

Please refer to FIG. 1, the LED backlight driver according to the embodiment of the present invention comprises a DC voltage input end 11, a boost circuit 12, an LED string 13, and a constant current driver 14.

The DC voltage input end 11 is used for inputting a DC voltage (for example, 24V). The DC voltage is converted from an AC voltage (for example, 110V or 220V). For example, a prior art AC/DC conversion circuit may be utilized to convert the AC voltage to the DC voltage.

The boost circuit 12 is used for boosting the DC voltage input from the DC voltage input end 11 and outputting a boosted DC voltage.

The LED string 13, disposed behind a liquid crystal display panel of a LCD, is used as a backlight. The LED string 13 comprises a plurality of LEDs connected in series and a first resistor R1. The LED string 13 receives the boosted DC voltage from the boost circuit 12. A number of the LEDs N (N is an integer greater than zero) in the LED string 13 is determined by the following equation:

$$N \times Vd \leq Vs,$$

where Vd represents a forward voltage of each of the LEDs, and Vs represents the boosted DC voltage output from the boost circuit 12.

For example, when Vd=5.5V and Vs=60V, N≤10.

Optionally, the LED string 13 may not comprise the first resistor R1.

The constant current driver 14 is used for outputting a level signal to the boost circuit 12 based on a voltage across the first resistor R1 (namely the voltage at a negative end of the LED string 13) and a voltage for a triangular signal. The level signal is a driving signal that drives the boost circuit 12 to provide the boosted DC voltage to the LED string 13.

Figure 2:
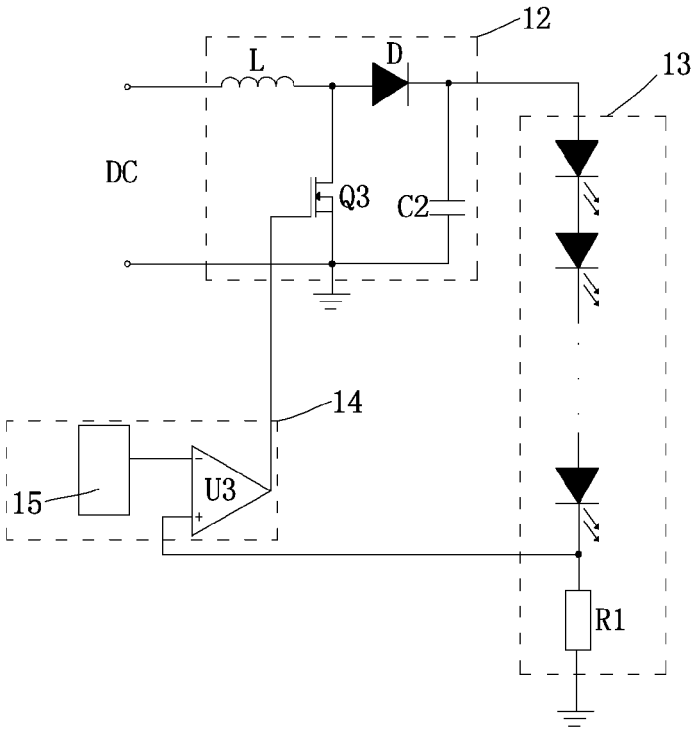
FIG. 2 shows a circuit diagram of the boost circuit and the constant current driver of the LED backlight driver according to an embodiment of the present invention.

FIG. 2 shows a circuit diagram of the boost circuit and the constant current driver of the LED backlight driver according to an embodiment of the present invention.

As shown in FIG. 2, the boost circuit 12 according to the embodiment of the present invention comprises an inductor L, a third metal oxide semiconductor (MOS) transistor Q3, a rectifying diode D, and a second capacitor C2. One end of the inductor L is used for receiving the DC voltage, and another end of the inductor L is connected to an anode of the rectifying diode D. A drain of the third MOS transistor Q3 is connected to the inductor L and the anode of the rectifying diode D. One end of the second capacitor C2 is connected to a cathode of the rectifying diode D, and another end of the second capacitor C2 is connected to a source of the third MOS transistor Q3. A gate of the third MOS transistor Q3 is connected to the constant current driver 14.

The boosted DC voltage provided by the boost circuit 12 to the LED string 13 is controlled by driving the gate of the third MOS transistor Q3 with the level signal output by the constant current driver 14.

The constant current driver 14 according to the embodiment of the present invention comprises a triangular wave generator 15 and a third comparator U3.

The triangular wave generator 15 is used for generating the triangular signal. The third comparator U3 compares the voltage for the triangular signal and the voltage across the first resistor R1. A negative terminal of the third comparator U3 receives the voltage for the triangular signal, and a positive terminal of the third comparator U3 receives the voltage across the first resistor R1. When the voltage for the triangular signal is higher than the voltage across the first resistor R1, an output terminal of the third comparator U3 outputs a first level signal to the gate of the third MOS transistor Q3 of the boost circuit 12. When the voltage for the triangular signal is lower than the voltage across the first resistor R1, the output terminal of the third comparator U3 outputs a second level signal to the gate of the third MOS transistor Q3 of the boost circuit 12.

It is understandable that the first level signal is a low level signal, and the second level signal is a high level signal. Or, the first level signal is a high level signal, and the second level signal is a low level signal.

Figure 3:
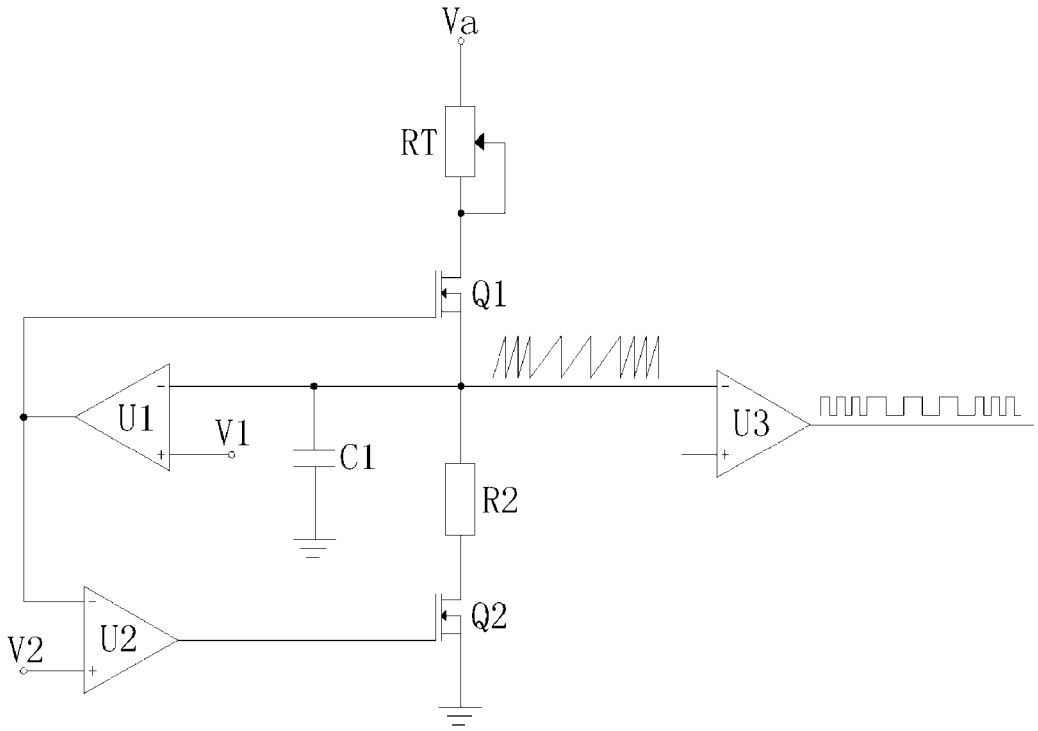
FIG. 3 is a circuit diagram of the triangular wave generator according to an embodiment of the present invention.

FIG. 3 is a circuit diagram of the triangular wave generator according to an embodiment of the present invention.

As shown in FIG. 3, the triangular wave generator 15 according to the embodiment of the present invention comprises a variable resistor RT, a first MOS transistor Q1, a first comparator U1, a second comparator U2, a first capacitor C1, a second resistor R2, and a second MOS transistor Q2.

One end of the variable resistor RT receives an input voltage Va, another end of the variable resistor RT is connected to a drain of the first MOS transistor Q1. A source of the first MOS transistor Q1 is connected to one end of the second resistor R2 and the negative terminal of the third comparator U3. Another end of the second resistor R2 is connected to a drain of the second MOS transistor Q2. A source of the second MOS transistor Q2 is electrically grounded. A gate of the first MOS transistor Q1 is connected to an output terminal of the first comparator U1, and a gate of the second MOS transistor Q2 is connected to an output terminal of the second comparator U2. A negative terminal of the first comparator U1 is connected to one end of the first capacitor C1 and the source of the first MOS transistor Q1. Another end of the first capacitor C1 is electrically grounded. A positive terminal of the first comparator U1 receives a first reference voltage V1. A negative terminal of the second comparator U2 is connected to the output terminal of the first comparator U1. A positive terminal of the second comparator U2 receives a second reference voltage V2.

When the constant current driver 14 is activated, a reference voltage Vref (for example, 5V) is generated in it. The reference voltage Vref is then divided by resistors to obtain the above-mentioned input voltage Va, the first reference voltage V1, and the second reference voltage V2.

As mentioned previously, the input voltage Va is obtained after the constant current driver 14 is activated. The input voltage Va charges the first capacitor C1, and the magnitude of the resistance of the variable resistor RT determines the magnitude of the charging current passing through the first capacitor C1 by the input voltage Va. The charging voltage of the first capacitor C1 rises slowly at a specific slope (the slope is related to the magnitude of the charging current passing through the first capacitor C1). When the charging voltage of the first capacitor C1 is higher than the first reference voltage V1, the output terminal of the first comparator U1 outputs a low voltage level to the gate of the first MOS transistor Q1. The first MOS transistor Q1 is cut off so the input voltage Va stops charging the first capacitor C1. The low voltage level output by the output terminal of the first comparator U1 is lower than the second reference voltage V2 so the second MOS transistor Q2 is turned on. The first capacitor C1 thus discharges through the second resistor R2. When the charging voltage of the first capacitor C1 is decreased and lower than the first reference voltage V1, the output terminal of the first comparator U1 outputs a high voltage level so the first MOS transistor Q1 is turned on. The high voltage level output by the output terminal of the first comparator U1 is higher than the second reference voltage V2 so the second MOS transistor Q2 is cut off. The input voltage Va starts charging the first capacitor C1 again. Repeatedly, the voltage on the first capacitor C1 will form the triangular signal having a specific frequency. The triangular signal is input to the negative terminal of the third comparator U3 and compared with the voltage across the first resistor R1. The third comparator U3 then outputs the level signal to the gate of the third MOS transistor Q3 of the boost circuit 12 based on the comparing result. It is worth noticing that the frequency of the level signal is equal to the frequency of the triangular signal.

Furthermore, the frequency of the triangular signal may be adjusted by adjusting the magnitude of the input voltage Va. When the input voltage Va is increased, the charging current passing through the first capacitor C1 is increased. Hence, the charging voltage of the first capacitor C1 is increased to make the triangular signal rise at a larger slope. As a result, the frequency of the triangular signal is increased. When the input voltage Va is decreased, the charging current passing through the first capacitor C1 is decreased. The charging voltage of the first capacitor C1 is thus decreased to make the triangular signal rise at a smaller slope. As a result, the frequency of the triangular signal is decreased.

In addition, the frequency of the triangular signal may be adjusted by adjusting the magnitude of the resistance of the variable resistor RT if the input voltage Va is kept constant. When the resistance of the variable resistor RT is decreased, the charging current passing through the first capacitor C1 is increased. Hence, the charging voltage of the first capacitor C1 is increased to make the triangular signal rise at a larger slope. As a result, the frequency of the triangular signal is increased. When the resistance of the variable resistor RT is increased, the charging current passing through the first capacitor C1 is decreased. The charging voltage of the first capacitor C1 is thus decreased to make the triangular signal rise at a smaller slope. As a result, the frequency of the triangular signal is decreased.

Although FIG. 3 has depicted the triangular wave generator 15 according to one embodiment of the present invention, the present invention is not limited to this. The present invention may also adopt another triangular wave generator being able to adjust the frequency of the output triangular signals.

Figure 4:
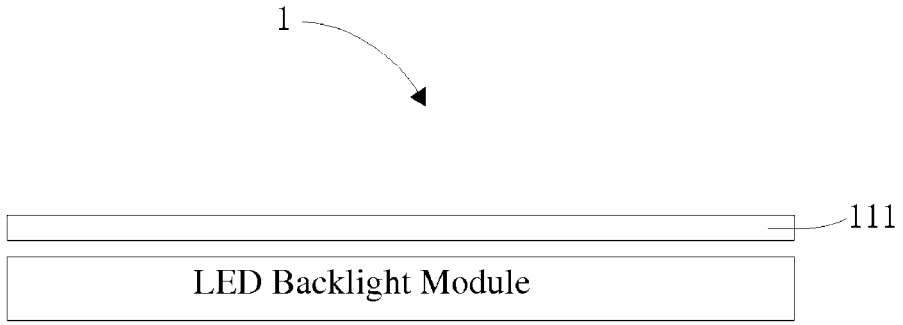
FIG. 4 is a schematic diagram showing a liquid crystal display according to an embodiment of the present invention.

FIG. 4 is a schematic diagram showing a liquid crystal display according to an embodiment of the present invention.

As shown in FIG. 4, the liquid crystal display 1 comprises a liquid crystal display panel 111 and an LED backlight module. The liquid crystal display panel 111 is disposed on the LED backlight module. The LED backlight module provides light to the liquid crystal display panel 111 so the liquid crystal display panel 111 displays images.

In summary, the LED backlight driver, the LED backlight module, and the liquid crystal display according to the embodiments of the present invention control the frequency of the triangular signal periodically by periodically adjusting the magnitude of the input voltage Va or the magnitude of the resistance of the variable resistor RT. Therefore, the level signal (namely the driving signal) transmitted to the gate of the third MOS transistor Q3 changes periodically to allow the frequency of the driving signal moves back and forth around the center frequency. The spectrum energy of the driving signal is thus spread. In EMI test, the peak value of the driving signal will not be easily to be excessive. As a result, the EMI test results are improved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An LED backlight driver, comprising:

a DC voltage input end used for inputting a DC voltage;

a boost circuit used for boosting the DC voltage input from the DC voltage input end and outputting a boosted DC voltage;

an LED string comprising a plurality of LEDs connected in series and a first resistor, the LED string receiving the boosted DC voltage from the boost circuit, and a sum of forward voltages of all of the LEDs in the LED string being less than or equal to the boosted DC voltage output from the boost circuit; and a constant current driver used for outputting a level signal to the boost circuit based on a voltage across the first resistor and a voltage for a triangular signal, the constant current driver comprising a triangular wave generator for generating the triangular signal, the triangular wave generator comprising a variable resistor, a first MOS transistor, a first comparator, a second comparator, a first capacitor, a second resistor, and a second MOS transistor;

wherein one end of the variable resistor receives an input voltage, another end of the variable resistor is connected to a drain of the first MOS transistor, a source of the first MOS transistor is connected to one end of the second resistor and a negative terminal of a third comparator, another end of the second resistor is connected to a drain of the second MOS transistor, a source of the second MOS transistor is electrically grounded, a gate of the first MOS transistor is connected to an output terminal of the first comparator, a gate of the second MOS transistor is connected to an output terminal of the second comparator, a negative terminal of the first comparator is connected to one end of the first capacitor and the source of the first MOS transistor, another end of the first capacitor is electrically grounded, a positive terminal of the first comparator receives a first reference voltage, a negative terminal of the second comparator is connected to the output terminal of the first comparator, and a positive terminal of the second comparator receives a second reference voltage, when a charging voltage of the first capacitor is higher than the first reference voltage, the output terminal of the first comparator outputs a low voltage level to the gate of the first MOS transistor, the first MOS transistor is cut off so the input voltage stops charging the first capacitor, the low voltage level output by the output terminal of the first comparator is lower than the second reference voltage so the second MOS transistor is turned on, the first capacitor thus discharges through the second resistor, when the charging voltage of the first capacitor is decreased and lower than the first reference voltage, the output terminal of the first comparator outputs a high voltage level so the first MOS transistor is turned on, the high voltage level output by the output terminal of the first comparator is higher than the second reference voltage so the second MOS transistor is cut off, the input voltage starts charging the first capacitor again.

2. The LED backlight driver as claimed in claim 1, wherein the constant current driver comprises:

the triangular wave generator for generating the triangular signal; and the third comparator use for comparing the voltage for the triangular signal and the voltage across the first resistor;

wherein the negative terminal of the third comparator receives the voltage for the triangular signal, a positive terminal of the third comparator receives the voltage across the first resistor, when the voltage for the triangular signal is higher than the voltage across the first resistor, an output terminal of the third comparator outputs a first level signal to the boost circuit, when the voltage for the triangular signal is lower than the voltage across the first resistor, the output terminal of the third comparator outputs a second level signal to the boost circuit.

3. The LED backlight driver as claimed in claim 1, wherein the boost circuit comprises an inductor, a third MOS transistor, a rectifying diode, and a second capacitor;

wherein one end of the inductor is used for receiving the DC voltage, another end of the inductor is connected to an anode of the rectifying diode, a drain of the third MOS transistor is connected to the inductor and the anode of the rectifying diode, one end of the second capacitor is connected to a cathode of the rectifying diode, another end of the second capacitor is connected to a source of the third MOS transistor, and a gate of the third MOS transistor is connected to the constant current driver.

4. The LED backlight driver as claimed in claim 1, wherein the frequency of the triangular signal is adjusted by adjusting the magnitude of the input voltage;

wherein when the input voltage is increased, a charging current passing through the first capacitor is increased, the charging voltage of the first capacitor is increased to make the triangular signal rise at a larger slope so the frequency of the triangular signal is increased, when the input voltage is decreased, the charging current passing through the first capacitor is decreased, the charging voltage of the first capacitor is decreased to make the triangular signal rise at a smaller slope so the frequency of the triangular signal is decreased.

5. The LED backlight driver as claimed in claim 1, wherein the frequency of the triangular signal is adjusted by adjusting the magnitude of the resistance of the variable resistor;

wherein when the resistance of the variable resistor is decreased, a charging current passing through the first capacitor is increased, the charging voltage of the first capacitor is increased to make the triangular signal rise at a larger slope so the frequency of the triangular signal is increased, when the resistance of the variable resistor is increased, the charging current passing through the first capacitor is decreased, the charging voltage of the first capacitor is decreased to make the triangular signal rise at a smaller slope so the frequency of the triangular signal is decreased.

6. The LED backlight driver as claimed in claim 2, wherein the first level signal is a low level signal, and the second level signal is a high level signal.

7. An LED backlight module comprising an LED backlight driver, the LED backlight driver comprising:

a DC voltage input end used for inputting a DC voltage;

a boost circuit used for boosting the DC voltage input from the DC voltage input end and outputting a boosted DC voltage;

an LED string comprising a plurality of LEDs connected in series and a first resistor, the LED string receiving the boosted DC voltage from the boost circuit, and a sum of forward voltages of all of the LEDs in the LED string being less than or equal to the boosted DC voltage output from the boost circuit; and a constant current driver used for outputting a level signal to the boost circuit based on a voltage across the first resistor and a voltage for a triangular signal, the constant current driver comprising a triangular wave generator for generating the triangular signal, the triangular wave generator comprising a variable resistor, a first MOS transistor, a first comparator, a second comparator, a first capacitor, a second resistor, and a second MOS transistor;

wherein one end of the variable resistor receives an input voltage, another end of the variable resistor is connected to a drain of the first MOS transistor, a source of the first MOS transistor is connected to one end of the second resistor and a negative terminal of a third comparator, another end of the second resistor is connected to a drain of the second MOS transistor, a source of the second MOS transistor is electrically grounded, a gate of the first MOS transistor is connected to an output terminal of the first comparator, a gate of the second MOS transistor is connected to an output terminal of the second comparator, a negative terminal of the first comparator is connected to one end of the first capacitor and the source of the first MOS transistor, another end of the first capacitor is electrically grounded, a positive terminal of the first comparator receives a first reference voltage, a negative terminal of the second comparator is connected to the output terminal of the first comparator, and a positive terminal of the second comparator receives a second reference voltage, when a charging voltage of the first capacitor is higher than the first reference voltage, the output terminal of the first comparator outputs a low voltage level to the gate of the first MOS transistor, the first MOS transistor is cut off so the input voltage stops charging the first capacitor, the low voltage level output by the output terminal of the first comparator is lower than the second reference voltage so the second MOS transistor is turned on, the first capacitor thus discharges through the second resistor, when the charging voltage of the first capacitor is decreased and lower than the first reference voltage, the output terminal of the first comparator outputs a high voltage level so the first MOS transistor is turned on, the high voltage level output by the output terminal of the first comparator is higher than the second reference voltage so the second MOS transistor is cut off, the input voltage starts charging the first capacitor again.

8. The LED backlight module as claimed in claim 7, wherein the constant current driver comprises:

the triangular wave generator for generating the triangular signal; and the third comparator use for comparing the voltage for the triangular signal and the voltage across the first resistor;

wherein the negative terminal of the third comparator receives the voltage for the triangular signal, a positive terminal of the third comparator receives the voltage across the first resistor, when the voltage for the triangular signal is higher than the voltage across the first resistor, an output terminal of the third comparator outputs a first level signal to the boost circuit, when the voltage for the triangular signal is lower than the voltage across the first resistor, the output terminal of the third comparator outputs a second level signal to the boost circuit.

9. The LED backlight module as claimed in claim 7, wherein the boost circuit comprises an inductor, a third MOS transistor, a rectifying diode, and a second capacitor;

wherein one end of the inductor is used for receiving the DC voltage, another end of the inductor is connected to an anode of the rectifying diode, a drain of the third MOS transistor is connected to the inductor and the anode of the rectifying diode, one end of the second capacitor is connected to a cathode of the rectifying diode, another end of the second capacitor is connected to a source of the third MOS transistor, and a gate of the third MOS transistor is connected to the constant current driver.

10. The LED backlight module as claimed in claim 7, wherein the frequency of the triangular signal is adjusted by adjusting the magnitude of the input voltage;

wherein when the input voltage is increased, a charging current passing through the first capacitor is increased, the charging voltage of the first capacitor is increased to make the triangular signal rise at a larger slope so the frequency of the triangular signal is increased, when the input voltage is decreased, the charging current passing through the first capacitor is decreased, the charging voltage of the first capacitor is decreased to make the triangular signal rise at a smaller slope so the frequency of the triangular signal is decreased.

11. The LED backlight module as claimed in claim 7, wherein the frequency of the triangular signal is adjusted by adjusting the magnitude of the resistance of the variable resistor;

wherein when the resistance of the variable resistor is decreased, a charging current passing through the first capacitor is increased, the charging voltage of the first capacitor is increased to make the triangular signal rise at a larger slope so the frequency of the triangular signal is increased, when the resistance of the variable resistor is increased, the charging current passing through the first capacitor is decreased, the charging voltage of the first capacitor is decreased to make the triangular signal rise at a smaller slope so the frequency of the triangular signal is decreased.

12. The LED backlight module as claimed in claim 8, wherein the first level signal is a low level signal, and the second level signal is a high level signal.

13. A liquid crystal display comprising a liquid crystal display panel and an LED backlight module, the liquid crystal display panel being disposed on the LED backlight module, and the LED backlight module comprising an LED backlight driver, the LED backlight driver comprising:

a DC voltage input end used for inputting a DC voltage;

a boost circuit used for boosting the DC voltage input from the DC voltage input end and outputting a boosted DC voltage;

an LED string comprising a plurality of LEDs connected in series and a first resistor, the LED string receiving the boosted DC voltage from the boost circuit, and a sum of forward voltages of all of the LEDs in the LED string being less than or equal to the boosted DC voltage output from the boost circuit; and a constant current driver used for outputting a level signal to the boost circuit based on a voltage across the first resistor and a voltage for a triangular signal, the constant current driver comprising a triangular wave generator for generating the triangular signal, the triangular wave generator comprising a variable resistor, a first MOS transistor, a first comparator, a second comparator, a first capacitor, a second resistor, and a second MOS transistor;

wherein one end of the variable resistor receives an input voltage, another end of the variable resistor is connected to a drain of the first MOS transistor, a source of the first MOS transistor is connected to one end of the second resistor and a negative terminal of a third comparator, another end of the second resistor is connected to a drain of the second MOS transistor, a source of the second MOS transistor is electrically grounded, a gate of the first MOS transistor is connected to an output terminal of the first comparator, a gate of the second MOS transistor is connected to an output terminal of the second comparator, a negative terminal of the first comparator is connected to one end of the first capacitor and the source of the first MOS transistor, another end of the first capacitor is electrically grounded, a positive terminal of the first comparator receives a first reference voltage, a negative terminal of the second comparator is connected to the output terminal of the first comparator, and a positive terminal of the second comparator receives a second reference voltage, when a charging voltage of the first capacitor is higher than the first reference voltage, the output terminal of the first comparator outputs a low voltage level to the gate of the first MOS transistor, the first MOS transistor is cut off so the input voltage stops charging the first capacitor, the low voltage level output by the output terminal of the first comparator is lower than the second reference voltage so the second MOS transistor is turned on, the first capacitor thus discharges through the second resistor, when the charging voltage of the first capacitor is decreased and lower than the first reference voltage, the output terminal of the first comparator outputs a high voltage level so the first MOS transistor is turned on, the high voltage level output by the output terminal of the first comparator is higher than the second reference voltage so the second MOS transistor is cut off, the input voltage starts charging the first capacitor again.

14. The liquid crystal display as claimed in claim 13, wherein the constant current driver comprises:

the triangular wave generator for generating the triangular signal; and the third comparator use for comparing the voltage for the triangular signal and the voltage across the first resistor;

wherein the negative terminal of the third comparator receives the voltage for the triangular signal, a positive terminal of the third comparator receives the voltage across the first resistor, when the voltage for the triangular signal is higher than the voltage across the first resistor, an output terminal of the third comparator outputs a first level signal to the boost circuit, when the voltage for the triangular signal is lower than the voltage across the first resistor, the output terminal of the third comparator outputs a second level signal to the boost circuit.

15. The liquid crystal display as claimed in claim 13, wherein the boost circuit comprises an inductor, a third MOS transistor, a rectifying diode, and a second capacitor;

wherein one end of the inductor is used for receiving the DC voltage, another end of the inductor is connected to an anode of the rectifying diode, a drain of the third MOS transistor is connected to the inductor and the anode of the rectifying diode, one end of the second capacitor is connected to a cathode of the rectifying diode, another end of the second capacitor is connected to a source of the third MOS transistor, and a gate of the third MOS transistor is connected to the constant current driver.

16. The liquid crystal display as claimed in claim 13, wherein the frequency of the triangular signal is adjusted by adjusting the magnitude of the input voltage;

wherein when the input voltage is increased, a charging current passing through the first capacitor is increased, the charging voltage of the first capacitor is increased to make the triangular signal rise at a larger slope so the frequency of the triangular signal is increased, when the input voltage is decreased, the charging current passing through the first capacitor is decreased, the charging voltage of the first capacitor is decreased to make the triangular signal rise at a smaller slope so the frequency of the triangular signal is decreased.

17. The liquid crystal display as claimed in claim 13, wherein the frequency of the triangular signal is adjusted by adjusting the magnitude of the resistance of the variable resistor;

wherein when the resistance of the variable resistor is decreased, a charging current passing through the first capacitor is increased, the charging voltage of the first capacitor is increased to make the triangular signal rise at a larger slope so the frequency of the triangular signal is increased, when the resistance of the variable resistor is increased, the charging current passing through the first capacitor is decreased, the charging voltage of the first capacitor is decreased to make the triangular signal rise at a smaller slope so the frequency of the triangular signal is decreased.

* * * * *